US008699909B2

(12) United States Patent
Shibuya et al.

(10) Patent No.: US 8,699,909 B2
(45) Date of Patent: Apr. 15, 2014

(54) IMAGE FORMING APPARATUS

(75) Inventors: Satoru Shibuya, Chiryu (JP); Hidetoshi Noguchi, Tahara (JP); Kazuyoshi Hara, Itami (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 150 days.

(21) Appl. No.: 13/045,175

(22) Filed: Mar. 10, 2011

(65) Prior Publication Data

US 2011/0229185 A1 Sep. 22, 2011

(30) Foreign Application Priority Data

Mar. 19, 2010 (JP) ..... 2010-064308

(51) Int. Cl.
*G03G 21/00* (2006.01)
*G03G 15/02* (2006.01)
*G03G 15/16* (2006.01)

(52) U.S. Cl.
USPC ..... 399/99; 399/100; 399/101

(58) Field of Classification Search
USPC ..... 399/99, 100, 101
See application file for complete search history.

(56) References Cited

U.S. PATENT DOCUMENTS 5,621,509 A 4/1997 Karashima et al.
5,970,279 A * 10/1999 Sakaizawa et al. ..... 399/46
6,118,952 A * 9/2000 Furuya ..... 399/50
6,243,544 B1 * 6/2001 Tsuneeda ..... 399/66
6,438,331 B2 8/2002 Sakaizawa et al.
2001/0026694 A1 * 10/2001 Sakaizawa et al. ..... 399/50
2007/0127944 A1 * 6/2007 Mochizuki ..... 399/101
2007/0217832 A1 * 9/2007 Oyama et al. ..... 399/302

FOREIGN PATENT DOCUMENTS

JP H03-069978 A * 3/1991 ..... G03G 15/16
JP 08-272235 A 10/1996
JP 2001-188405 A 10/2001

OTHER PUBLICATIONS

Search Report dated Jul. 1, 2011, issued in the corresponding European Patent Application No. 11158433.0-2209.
Japanese Notification of Reasons for Refusal dated Nov. 13, 2012 issued in the corresponding Japanese Patent Application No. 2010-064308 and English translation.

* cited by examiner

*Primary Examiner* — Clayton E Laballe
*Assistant Examiner* — Jas Sanghera
(74) *Attorney, Agent, or Firm* — Buchanan Ingersoll & Rooney PC

(57) ABSTRACT

An image forming apparatus having an image carrier that carries a toner image; an opposed member that is provided so as to be opposed to the image carrier; an application device that applies a bias to the opposed member; and a control device that controls the application device to apply a first bias and thereafter a second bias to the opposed member so as to remove toner from the opposed member. The first bias has an absolute value that is large enough to cause discharge from the opposed member into air. The second bias has an absolute value that is too small to cause discharge from the opposed member into the air, and has a reverse polarity to the first bias.

5 Claims, 8 Drawing Sheets

IMAGE FORMING APPARATUS

This application is based on Japanese Patent Application No. 2010-064308 filed on Mar. 19, 2010, the content of which is incorporated herein by reference.

BACKGROUND OF THE INVENTION

1. Field of the Invention

The present invention relates to an image forming apparatus, and particularly relates to an image forming apparatus that forms an image by means of toner.

2. Description of Related Art

As a conventional image forming apparatus, there is known, for example, an image forming apparatus described in Japanese Patent Laid-Open Publication No. H08-272235. Hereinafter, the image forming apparatus described in Japanese Patent Laid-Open Publication No. H08-272235 is described with reference to the drawings. FIG. 8 is a constitutional view of an image forming apparatus 500 described in Japanese Patent Laid-Open Publication No. H08-272235.

The image forming apparatus 500 includes an image carrier 502, a transfer member 504, and a bias application device 506. The image carrier 502 electrostatically carries a toner image. The transfer member 504 is in contact with the image carrier 502, and applies a transfer bias. The bias application device 506 sequentially applies to the transfer member 504 bias currents with different polarities from each other while the transfer member is not present at a transferred position. The bias application device 506 then applies a same-polarity current having the same polarity as toner constituting the toner image, and thereafter applies a reverse-polarity current having a reverse polarity to the toner and a current value equal to or greater than an absolute value of the same-polarity current. It is thereby possible to transfer toner from the transfer member 504 back to the image carrier 502 for cleaning, so as to prevent staining on the back of recording paper.

However, in the image forming apparatus 500 described in Japanese Patent Laid-Open Publication No. H08-272235, the toner adhering to the transfer member 504 cannot be sufficiently removed. More specifically, the bias application device 506 applies the same-polarity current having the same polarity as the toner constituting the toner image, and thereafter applies the reverse-polarity current having the reverse polarity to the toner and the current value equal to or greater than the absolute value of the same-polarity current. Hence in the case of the same-polarity current being small, the toner remains on the transfer member 504 after application of the same-polarity current. In this state, when the reverse polarity current having a larger absolute value than that of the same-polarity current is applied, the toner is drawn to the transfer member 504, and a large amount of toner remains on the transfer member 504.

On the other hand, in the case of the same-polarity current being large, discharge occurs due to the same-polarity current. When air in the vicinity of the transfer member 504 is decomposed by the discharge, a same-polarity ion with the same polarity as the toner and a reverse-polarity ion with a reverse polarity to the toner are generated. Then, the reverse-polarity ion is drawn to the transfer member 504 by the same-polarity current, and the polarity of the toner is reversed by the reverse-polarity ion. Subsequently, when the reverse polarity current having a larger absolute value than that of the same-polarity current is applied, the polarity of the toner, which was once reversed, is reversed again due to discharge. As a consequence, the toner is drawn to the transfer member 504 by the reverse-polarity current, and remains thereon. As thus described, in the image forming apparatus 500 described in Japanese Patent Laid-Open Publication No. H08-272235, it is difficult to sufficiently remove toner from the transfer member 504.

SUMMARY OF THE INVENTION

Accordingly, an object of the present invention is to provide an image forming apparatus capable of removing toner from an opposed member that is opposed to an image carrier.

An image forming apparatus according to one aspect of the present invention includes: an image carrier that carries a toner image; an opposed member that is provided so as to be opposed to the image carrier; an application device that applies a bias to the opposed member; and a control device that controls the application device to apply a first bias and thereafter a second bias to the opposed member so as to remove toner from the opposed member, wherein the first bias has an absolute value that is large enough to cause discharge from the opposed member into air, and the second bias has an absolute value that is too small to cause discharge from the opposed member into the air, and has a reverse polarity to the first bias.

BRIEF DESCRIPTION OF THE DRAWINGS

This and other objects and features of the present invention will be apparent from the following description with reference to the accompanying drawings, in which.

DETAILED DESCRIPTION OF THE PREFERRED EMBODIMENTS

Structure of Image Forming Apparatus

Figure 1:
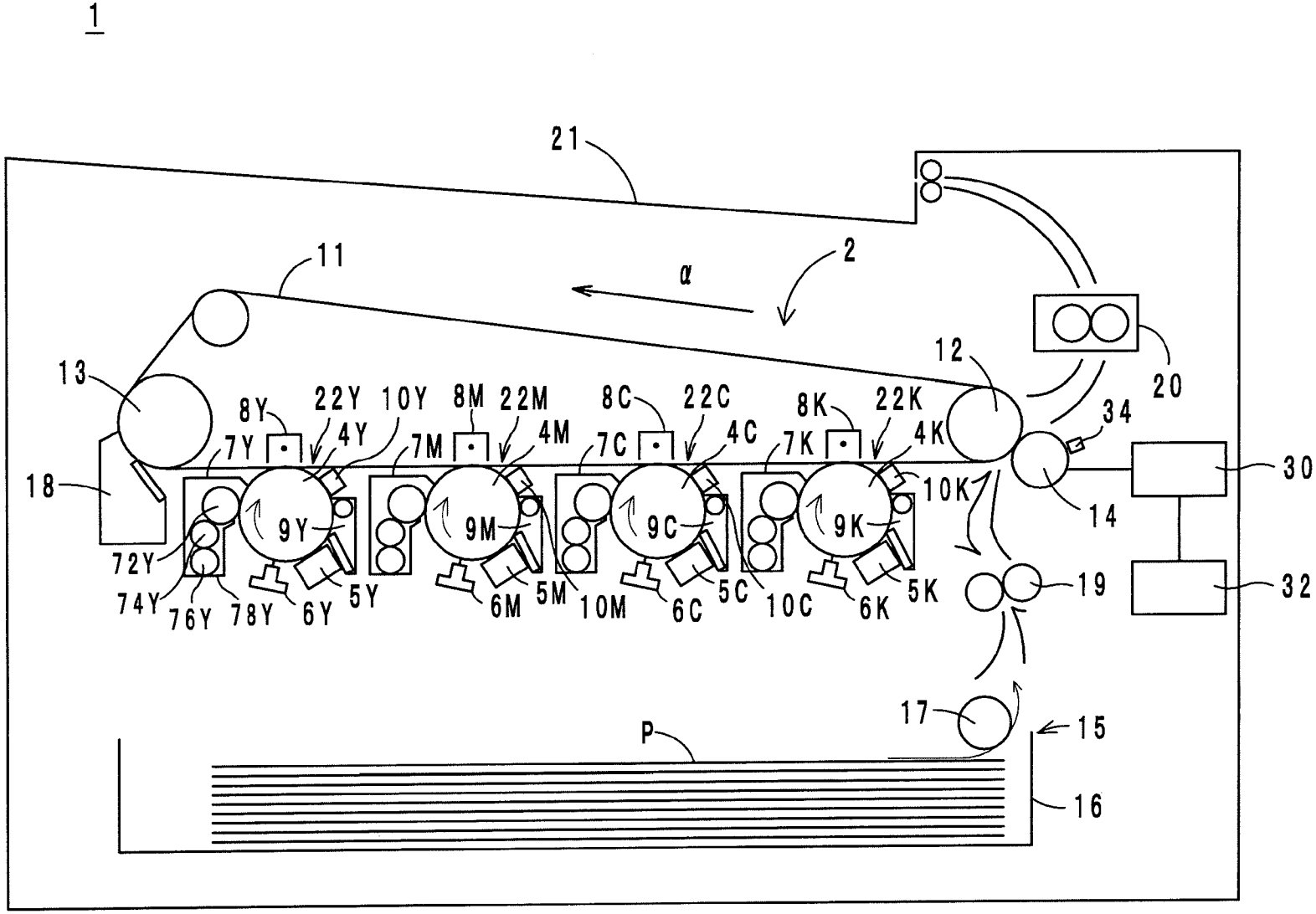
FIG. 1 is a view showing an overall structure of an image forming apparatus according to an embodiment of the present invention.

Hereinafter, an image forming apparatus according to an embodiment of the present invention is described with reference to the drawings. FIG. 1 is a view showing an overall structure of an image forming apparatus 1 according to the embodiment of the present invention.

Figure 2:
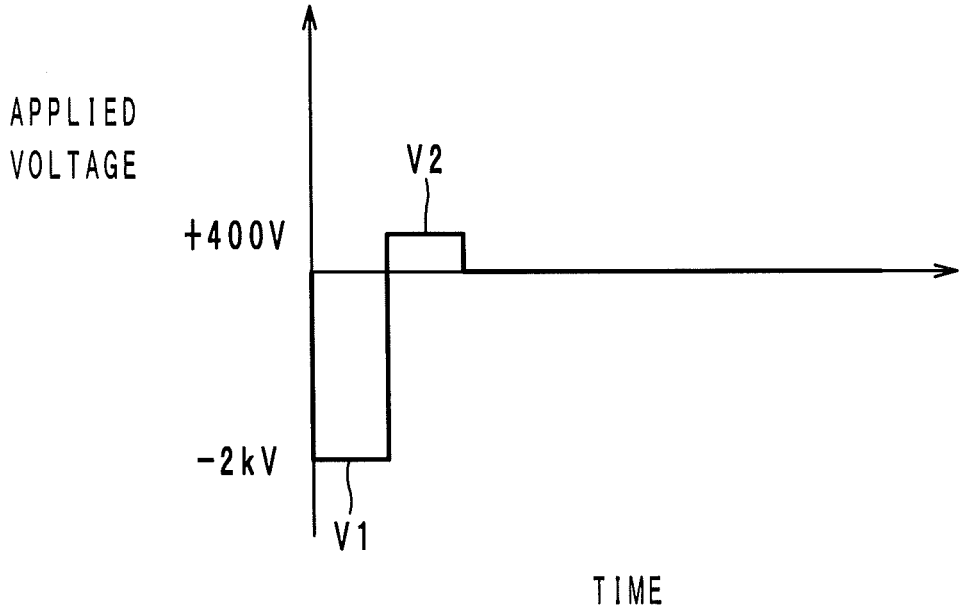
FIG. 2 is a graph showing a waveform of a bias voltage that is applied to a secondary transfer roller.
Figure 3:
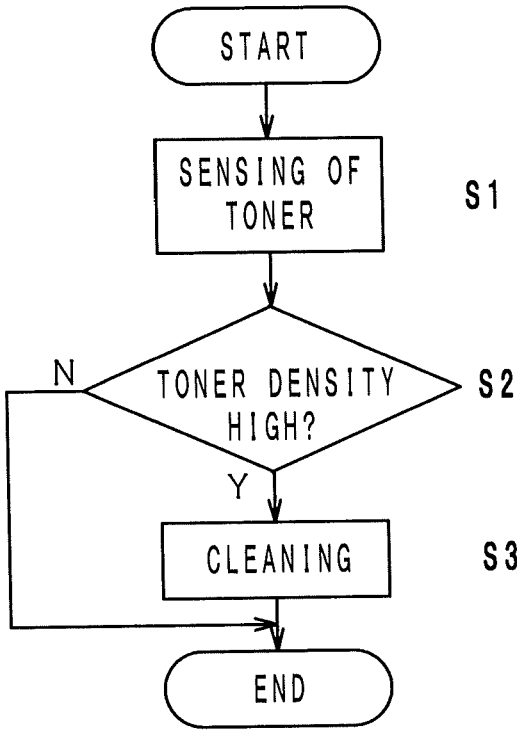
FIG. 3 is a flowchart showing an operation performed by a control section for cleaning of the secondary transfer roller.

An image forming apparatus 1 is an electrophotographic color printer of a tandem type, which is configured so as to synthesize an image of four colors, namely, Y (yellow), M (magenta), C (cyan) and K (black). The image forming apparatus 1 has a function of forming an image on paper (print medium) based upon image data read by a scanner, and as shown in FIGS. 1 to 3, the image forming apparatus 1 includes a printing section 2, a paper feeding section 15, a pair of timing rollers 19, a fixing unit 20, a paper discharge tray 21, a control section 30, a voltage application section 32, and a sensor (sensing device) 34.

The control section 30 controls an overall operation of the image forming apparatus 1, and is realized by a CPU. The paper feeding section 15 serves to feed paper P piece by piece, and includes a paper tray 16 and a paper feeding roller 17. In the paper tray 16, a plurality of pieces of paper P to be subjected to printing are stacked and placed. The paper feeding roller 17 takes out the paper from the paper tray 16 piece by piece. The pair of timing rollers 19 delivers the paper P, while adjusting the timing so that a toner image can be transferred to the paper P in the printing section 2 (secondary transfer).

The printing section 2 forms a toner image on the paper P being fed from the paper feeding section 15, and includes: an image forming section 22 (22Y, 22M, 22C, 22K); a transfer section 8 (8Y, 8M, 8C, 8K); an intermediate transfer belt (image carrier) 11; a driving roller 12; a driven roller 13; a secondary transfer roller (opposed member or transfer member) 14; and a cleaning unit 18. Further, the image forming section 22 (22Y, 22M, 22C, 22K) includes: a photosensitive drum 4 (4Y, 4M, 4C, 4K); a charger 5 (5Y, 5M, 5C, 5K); an exposure unit 6 (6Y, 6M, 6C, 6K); a development unit 7 (7Y, 7M, 7C, 7K); a cleaner 9 (9Y, 9M, 9C, 9K); and an eraser 10 (10Y, 10M, 10C, 10K).

The charger 5 charges the peripheral surface of the photosensitive drum 4. The exposure unit 6 applies a laser by control of the control section 30. Thereby, an electrostatic latent image is formed on the peripheral surface of the photosensitive drum 4. That is, the charger 5 and the exposure unit 6 serve as an electrostatic latent image forming device for forming an electrostatic latent image on the peripheral surface of the photosensitive drum 4.

As shown in FIG. 1, the development unit 7 (7Y, 7M, 7C, 7K) includes a development roller 72 (72Y, 72M, 72C, 72K), a feeding roller 74 (74Y, 74M, 74C, 74K), a stirring roller 76 (76Y, 76M, 76C, 76K), and a housing section 78 (78Y, 78M, 78C, 78K). In FIG. 1, for the sake of simplicity of the drawing, only the development roller 72Y, the feeding roller 74Y, the stirring roller 76Y, and the housing section 78Y of the development unit 7Y are provided with reference numerals.

The housing section 78 constitutes a body of the development unit 7, and houses the development roller 72, the feeding roller 74 and the stirring roller 76. Further, toner is stored in the housing section 78. The stirring roller 76 stirs the toner inside the housing section 78 to negatively charge the toner. The feeding roller 74 feeds the negatively charged toner to the development roller 72. The development roller 72 imparts the toner to the photosensitive drum 4. Specifically, a negative development bias voltage is applied to the development roller 72 to form a development field between the photosensitive drum 4 and the development roller 72. Since the toner is negatively charged, the toner moves from the development roller 72 to the photosensitive drum 4 under the influence of the development field. Further, since the electrostatic latent image is formed on the photosensitive drum 4, the toner adheres to the photosensitive drum 4 based upon the electrostatic latent image. A toner image based upon the electrostatic latent image is thereby developed on the photosensitive drum 4.

The intermediate transfer belt 11 is extended between the driving roller 12 and the driven roller 13, and the toner image developed on the photosensitive drum 4 is primarily transferred. The transfer section 8 is arranged so as to be opposed to the inner peripheral surface of the intermediate transfer belt 11. A primary transfer voltage is applied to the transfer section 8, and thereby, the toner image formed on the photosensitive drum 4 is transferred to the intermediate transfer belt 11 (primary transfer). The cleaner 9 serves to collect the toner remaining on the peripheral surface of the photosensitive drum 4 after the primary transfer. The eraser 10 removes a charge on the peripheral surface of the photosensitive drum 4. The driving roller 12 is rotated by an intermediate transfer belt driving section (not shown in FIG. 1) to drive the intermediate transfer belt 11 in a direction of an arrow $\alpha$. Thereby, the intermediate transfer belt 11 carries the toner image to the secondary transfer roller 14. Thus, the intermediate transfer belt 11 functions as an image carrier for carrying and delivering a negatively charged toner image.

The secondary transfer roller 14, which is in the shape of a drum, is opposed to (in contact with) the intermediate transfer belt 11. A transfer voltage is applied to the secondary transfer roller 14, and thereby, the toner image carried by the intermediate transfer belt 11 is transferred to the paper P passing between the intermediate transfer belt 11 and the secondary transfer roller 14 (secondary transfer). More specifically, the driving roller 12 is held in a ground potential. Further, the intermediate transfer belt 11 is in contact with the driving roller 12, and thereby held in a positive potential close to the ground potential. The voltage application section 32 applies a positive transfer voltage to the secondary transfer roller 14 such that the potential of the secondary transfer roller 14 will be higher than those of the driving roller 12 and the intermediate transfer belt 11. Since the toner image is negatively charged, the toner image is transferred from the intermediate transfer belt 11 to the paper P through the electric field generated between the driving roller 12 and the secondary transfer roller 14.

The sensor 34 is provided so as to be opposed to the peripheral surface of the secondary transfer roller 14, and senses the amount of toner (toner density) adhering to the secondary transfer roller 14.

The cleaning unit 18 removes the toner remaining on the intermediate transfer belt 11 after the secondary transfer of the toner image to the paper P.

The paper P with the toner image transferred thereto is delivered to the fixing unit 20. The fixing unit 20 performs a heating treatment and a pressure treatment on the paper P, thereby fixing the toner image to the paper P. In the paper discharge tray 21, the printed paper P is placed.

Cleaning of Secondary Transfer Roller

In the image forming apparatus 1, the toner adhering to the intermediate transfer belt 11 may adhere to the secondary transfer roller 14. The toner adhesion to the secondary transfer roller 14 causes staining of the back face of the paper P. Hence, it is required to clean the secondary transfer roller 14 regularly. Hereinafter, cleaning of the secondary transfer roller 14 is described with reference to the drawings. FIG. 2 is a graph showing a waveform of a bias voltage that is applied to the secondary transfer roller 14. A vertical axis indicates a voltage, and a horizontal axis indicates time. It is to be noted that a bias voltage shown in FIG. 2 is referred to as a pattern 1.

At the time of cleaning the secondary transfer roller 14, that is, at the time of removing toner from the secondary transfer roller 14, the control section 30 controls the voltage application section 32 to apply a bias voltage V1 shown in FIG. 2 to the secondary transfer roller 14. The bias voltage V1 is a negative voltage, with which the potential of the secondary transfer roller 14 becomes lower than that of the intermediate transfer belt 11. The bias voltage V1 has the same polarity as that of the charge of the toner. Further, the bias voltage V1 has an absolute value that is large enough to cause discharge from the secondary transfer roller 14 into the air. The voltage to cause discharge from the secondary transfer roller 14 into the air must have an absolute value at least about 400 to 500 V. In the present embodiment, therefore, the bias voltage V1 is set to −2 kV. It should be noted that the control section 30 makes the voltage application section 32 keep applying the bias voltage V1 over a period when the secondary transfer roller 14 makes one rotation.

Most of the toner on the secondary transfer roller 14 is negatively charged. For this reason, when the negative bias voltage V1 is applied to the secondary transfer roller 14, an electric field with a direction from the intermediate transfer belt 11 to the secondary transfer roller 14 occurs, and the negatively charged toner moves from the secondary transfer roller 14 to the intermediate transfer belt 11 through the electric field.

Further, when the bias voltage V1 is applied to the secondary transfer roller 14, discharge occurs from the secondary transfer roller 14 into the air. The air separates into a positive ion and a negative ion due to the discharge. The positive ion is then drawn to the secondary transfer roller 14 through the electric field between the intermediate transfer belt 11 and the secondary transfer roller 14. With this positive ion, the toner comes to be positively charged. Therefore, the positively charged toner remains on the secondary transfer roller 14 even with application of the bias voltage V1.

Therefore, as shown in FIG. 2, the control section 30 controls the voltage application section 32 to apply a bias voltage V2 to the secondary transfer roller 14 after the application of the bias voltage V1. The bias voltage V2 is a positive voltage, with which the potential of the secondary transfer roller 14 becomes higher than that of the intermediate transfer belt 11. That is, the bias voltage V2 has a different polarity from the bias voltage V1, and also has a reverse polarity to the charge of the toner. Further, the bias voltage V2 has an absolute value that is too small to cause discharge from the secondary transfer roller 14 into the air. In the present embodiment, the bias voltage V2 is set to +400 V. It should be noted that the control section 30 makes the voltage application section 32 keep applying the bias voltage V2 over a period when the secondary transfer roller 14 makes one rotation.

The toner remaining on the secondary transfer roller 14 after the application of the bias voltage V1 is positively charged. For this reason, when the positive bias voltage V2 is applied, an electric field with a direction from the secondary transfer roller 14 to the intermediate transfer belt 11 occurs, and the positively charged toner moves from the secondary transfer roller 14 to the intermediate transfer belt 11 through the electric field.

Further, since discharge does not occur from the secondary transfer roller 14 into the air even with the application of the bias voltage V2, it is not possible that the positively charged toner is negatively charged due to discharge. Accordingly, little toner remains on the secondary transfer roller 14 after the application of the bias voltage V2. In this way, the secondary transfer roller 14 is cleaned.

Operation of Image Forming Apparatus

Next, an operation of the image forming apparatus 1 is described. FIG. 3 is a flowchart showing a procedure performed by the control section 30 for cleaning of the secondary transfer roller 14.

This procedure is performed after completion of printing on a predetermined number of pieces of paper, after occurrence of a jam or after execution of a stabilizing operation. First, the control section 30 senses the toner density on the secondary transfer roller 14 by the sensor 34 (step S1).

Next, the control section 30 determines whether or not the toner density sensed in step S1 is higher than a predetermined value (step S2). In step S2, the control section 30 determines whether or not cleaning of the secondary transfer roller 14 is necessary, based upon the sensing result of the sensor 34. Therefore, the predetermined value is such a toner density to cause a stain on the back face of the paper P to the visible degree. When the sensed toner density is higher than the predetermined value, the process goes to step S3. When the sensed toner density is not so high, the procedure is completed.

When the toner density is high, the control section 30 performs cleaning of the secondary transfer roller 14. Since the cleaning of the secondary transfer roller 14 has already been described in detail, a further description will not be given. Thereafter, the procedure is completed.

Effect

Figure 4:
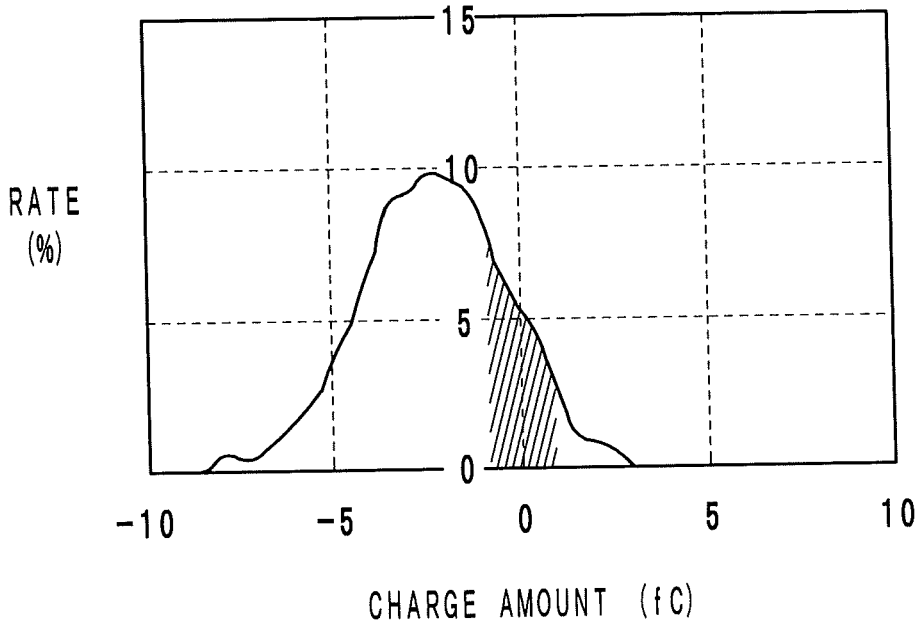
FIG. 4 is a graph showing a relation between a charge amount of toner adhering to the secondary transfer roller and appearance frequency of the toner.

According to the image forming apparatus 1 as thus configured, it is possible to remove toner from the secondary transfer roller 14. FIG. 4 is a graph showing the distribution of toner adhering to the secondary transfer roller 14 in relation to the charge amount of the toner. A vertical axis indicates the rate, and a horizontal axis indicates the charge amount. In addition, the graph of FIG. 4 was obtained using E-Spart Analyzer, manufactured by Hosokawa Micron Corporation.

As shown in FIG. 4, most of the toner adhering to the secondary transfer roller 14 is negatively charged. However, among the toner adhering to the secondary transfer roller 14, there exist positively charged toner and almost uncharged toner as indicated by oblique lines of FIG. 4. In particular, even when a small negative bias voltage is applied to the secondary transfer roller 14, the slightly charged toner as indicated by the oblique lines of FIG. 4 is only subjected to weak Coulomb force and thus hardly moves to the intermediate transfer belt 11.

Therefore, in the image forming apparatus 1, the negative bias voltage V1 having an absolute value that is large enough to cause discharge from the secondary transfer roller 14 into the air is applied to the secondary transfer roller 14. Thus, by applying an extremely large bias voltage V1 to the secondary transfer roller 14, it becomes possible that the almost uncharged toner as well as the negatively charged toner moves from the secondary transfer roller 14 to the intermediate transfer belt 11.

Further, upon application of the bias voltage V1 to the secondary transfer roller 14, the negatively charged toner comes to be positively charged due to the discharge. The positively charged toner thereby remains on the secondary transfer roller 14. Thereat, in the image forming apparatus 1, the positive bias voltage V2 having an absolute value that is too small to cause discharge from the secondary transfer roller 14 into the air is applied. The positively charged toner remaining on the secondary transfer roller 14 thereby moves to the intermediate transfer belt 11. As thus described, by the application of the bias voltage V1, the negatively charged toner and the almost uncharged toner are removed from the secondary transfer roller 14, and by the application of the bias voltage V2, the positively charged toner generated by the bias voltage V1 is removed from the secondary transfer roller 14.

It is therefore possible in the image forming apparatus 1 to remove toner from the secondary transfer roller 14.

Further, in the image forming apparatus 1, each of the periods when the bias voltages V1 and V2 are applied is equivalent to the period when the secondary transfer roller 14 makes one rotation. Thereby, in the image forming apparatus 1, the negatively charged toner and the almost uncharged toner are removed from the entire peripheral surface of the secondary transfer roller 14, and thereafter, the positively charged toner is removed from the entire peripheral surface of the secondary transfer roller 14. This results in cleaning of the entire peripheral surface of the secondary transfer roller 14.

Further, in the image forming apparatus 1, the control section 30 controls the voltage application section 32 to apply the bias voltages V1 and V2 based upon the sensing result of the sensor 34. This prevents unnecessary cleaning from being performed in the image forming apparatus 1, thereby resulting in reduction in power consumption.

Modifications of Bias Voltage

Figure 5A:
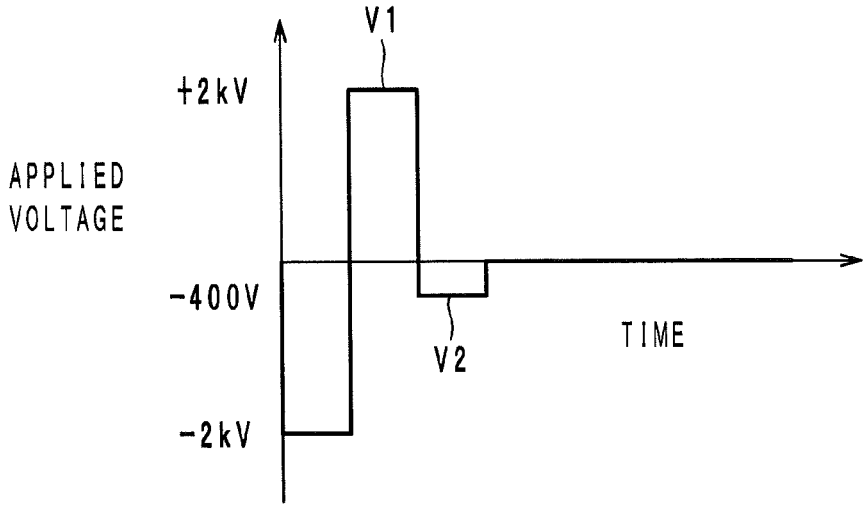
FIGS. 5A to 5C are graphs each showing a waveform of a bias voltage according to a modified example.
Figure 5B:
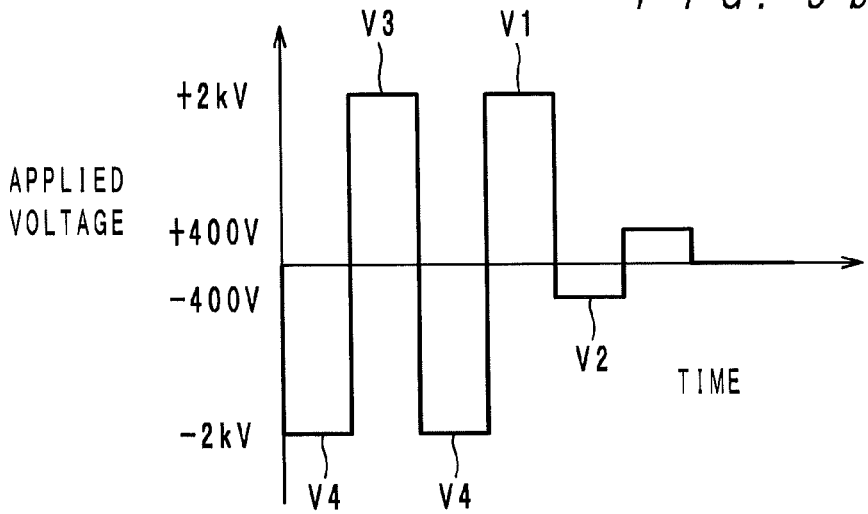
Figure 5C:
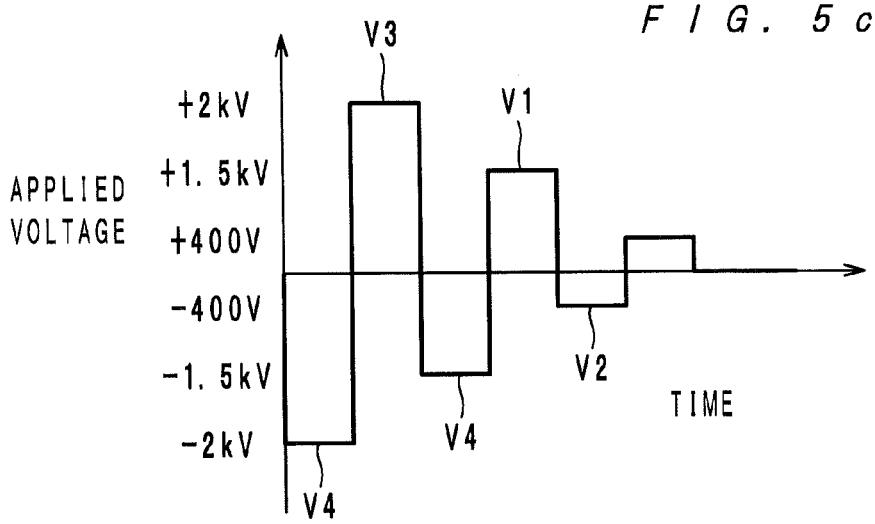

Hereinafter, modifications of a bias voltage to be applied to the secondary transfer roller 14 are described with reference to the drawings. FIGS. 5A to 5C are graphs showing waveforms of bias voltages according to the modifications. A horizontal axis indicates a voltage, and a vertical axis indicates time. It should be noted that the bias voltages shown in FIGS. 5A to 5C are respectively referred to as patterns 2 to 4.

As for the pattern 2 shown in FIG. 5A, after application of a bias voltage of −2 kV, a bias voltage of +2 kV is applied, and a bias voltage of −400 V is lastly applied. In this case, the bias voltage of +2 kV corresponds to the bias voltage V1, and the bias voltage of −400 V corresponds to the bias voltage V2. Like in this case, in the image forming apparatus 1, a bias voltage may further be applied before application of the bias voltages V1 and V2. Further, the bias voltage V1 and the bias voltage V2 may have different polarities from each other, and one may be a positive voltage while the other may be a negative voltage. As thus described, by increasing the number of times of alternate application of bias voltages of opposite polarities, the toner on the secondary transfer roller 14 can be reliably removed.

As for the pattern 3 shown in FIG. 5B, after alternate application of a bias voltage of −2 kV and a bias voltage of +2 kV twice each, a bias voltage of −400 V and a bias voltage of +400 V are alternately applied once each. In this case, the bias voltage of +2 kV applied for the second time corresponds to the bias voltage V1, and the bias voltage of −400 kV applied for the first time corresponds to the bias voltage V2. Further, the bias voltage of +2 kV applied before the application of the bias voltages V1 and V2 is taken as a bias voltage V3, and the bias voltage of −2 kV applied before the application of the bias voltages V1 and V2 is taken as a bias voltage V4. Like in this case, the control section 30 may control the voltage application section 32 so as to alternately apply to the secondary transfer roller 14 the bias voltages V3 and V4 having different polarities from each other before applying the bias voltage V1. At this time, the control section 30 makes the voltage application section 32 apply the bias voltages V3 and V4 over a period when the secondary transfer roller 14 makes one rotation. As thus described, by increasing the number of times of alternate application of bias voltages of opposite polarities, the toner on the secondary transfer roller 14 can be reliably removed.

As for the pattern 4 shown in FIG. 5C, after alternate application of a bias voltage of −2 kV and a bias voltage of +2 kV once each, a bias voltage of −1.5 kV and a bias voltage of +1.5 kV are alternately applied once each, and then a bias voltage of −400 V and a bias voltage of +400 V are alternately applied once each. In this case, the bias voltage of +1.5 kV corresponds to the bias voltage V1, and the bias voltage of −400 kV corresponds to the bias voltage V2. Further, the bias voltage of +2 kV applied before the application of the bias voltages V1 and V2 is taken as the bias voltage V3, and the bias voltage of −2 kV and a bias voltage of −1.5 kV that are applied before the application of the bias voltages V1 and V2 are taken as the bias voltages V4. Like in this case, the bias voltage may be set such that its absolute value becomes smaller with the passage of time.

Herein, there is described the cleaning effect of the bias voltages of the patterns 1 to 4. The present inventors performed cleaning of the secondary transfer roller 14 by use of the bias voltages of the patterns 1 to 4, shown in FIGS. 2 to 5, to evaluate the cleaning effect. Table 1 below shows the cleaning effect of the bias voltages of the patterns 1 to 4.

TABLE 1

| Bias Voltage | Pattern 1 | Pattern 2 | Pattern 3 | Pattern 4 |
|---|---|---|---|---|
| Cleaning Effect | Δ | ○ | ⊙ | ⊙ |

In Table 1, "x" indicates adhesion of toner to the secondary transfer roller 14 to the visible degree; "Δ" indicates adhesion of toner to the secondary transfer roller 14 only to such a degree not to cause problems in use; "○" indicates adhesion of little toner to the secondary transfer roller 14; and "⊙" indicates adhesion of no toner to the secondary transfer roller 14.

As shown in Table 1, it was possible to obtain more favorable cleaning effects with the bias voltages of the patterns 3 and 4 than with the bias voltages of the patterns 1 and 2. It is found from the above test results that increasing the number of times of alternate application of bias voltages of opposite polarities brings favorable results.

Bias Voltage V1

In the above embodiment, the bias voltage V1 is a voltage having an absolute value that is large enough to cause discharge from the secondary transfer roller 14 into the air. Thereat, the present inventors conducted a test for obtaining a preferable range for the bias voltage V1.

More specifically, cleaning was performed using the bias voltages of the patterns 1 to 4, to evaluate the cleaning effect. At this time, the absolute value of the bias voltage V1 was changed to 1.0 kV, 1.5 kV, and 2.0 kV. Table 2 below shows test results.

TABLE 2

| | | Bias Voltage | | | |
|---|---|---|---|---|---|
| | | Pattern 1 | Pattern 2 | Pattern 3 | Pattern 4 |
| Absolute Value of Bias Voltage V1 | 1.0 kV | x | x | — | — |
| | 1.5 kV | Δ | Δ | — | — |
| | 2.0 kV | Δ | ○ | ⊙ | ⊙ |

As shown in Table 2, it was not possible to obtain a favorable cleaning effect when the absolute value of the bias voltage V1 was 1.0 kV. On the other hand, it was possible to obtain a favorable cleaning effect when the absolute value of the bias voltage V1 was 1.5 kV or 2.0 kV. Hence, the absolute value of the bias voltage V1 is preferably not smaller than 1.5 kV and not larger than 2.0 kV.

Modifications of Operation of Image Forming Apparatus

Figure 6:
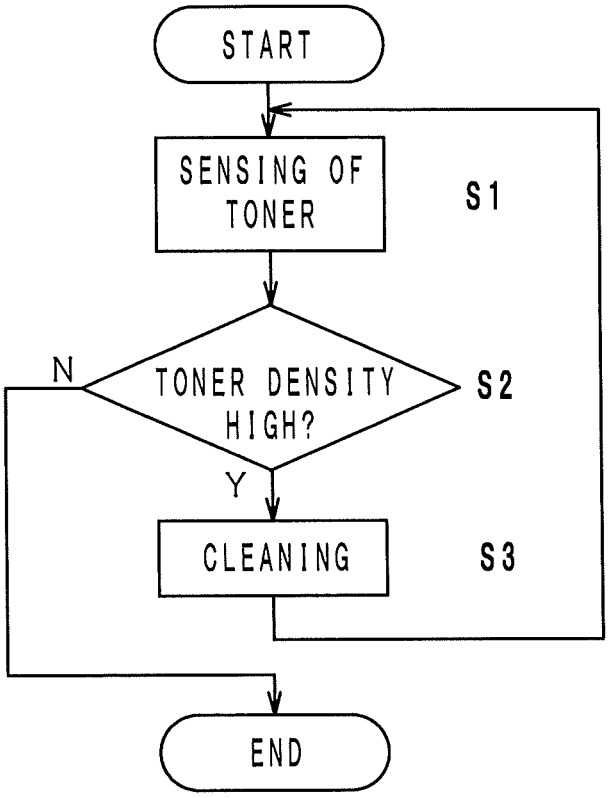
FIG. 6 is a flowchart showing an operation performed by the control section at the time of performing an operation according to a first modified example.

Next, a first modification of the operation of the image forming apparatus 1 is described. FIG. 6 is a flowchart showing a procedure executed by the control section 30 for the operation according to the first modification.

As shown in FIG. 6, the control section 30 may return to step S1 after executing step S3. Thereby, cleaning is repeated until the toner on the secondary transfer roller 14 is removed.

Figure 7:
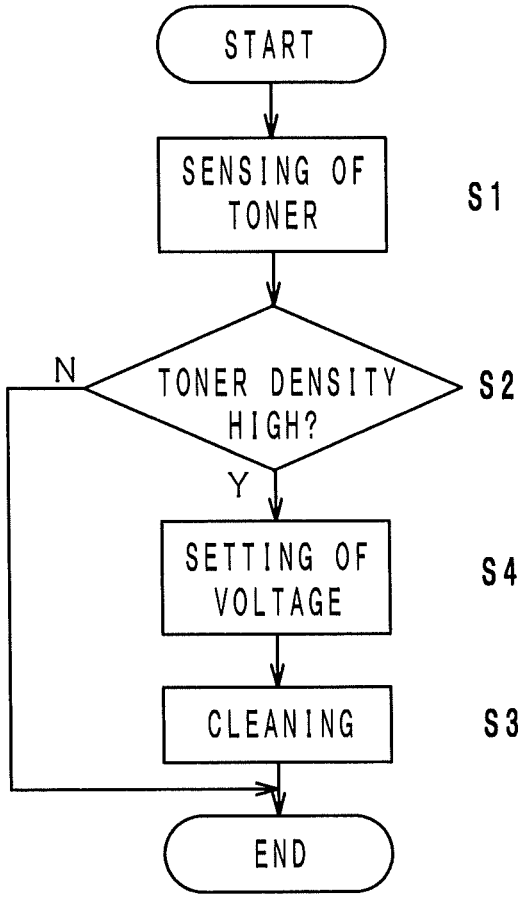
FIG. 7 is a flowchart showing an operation performed by the control section at the time of performing an operation according to a second modified example.
Figure 8:
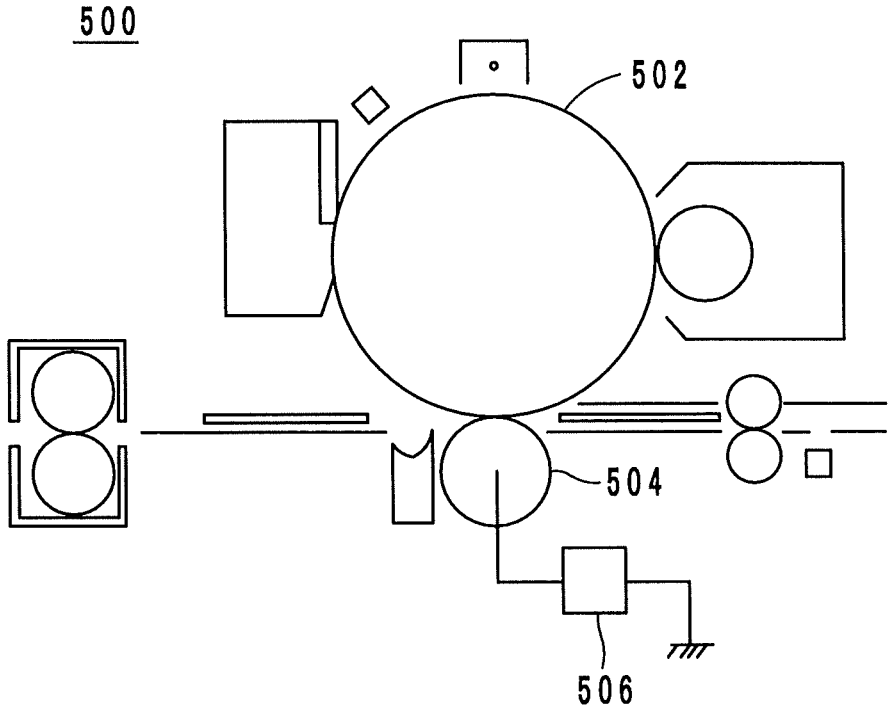
FIG. 8 is a constitutional view of an image forming apparatus described in Japanese Patent Laid-Open Publication No. H08-272235.

Next, a second modification of the operation of the image forming apparatus 1 is described. FIG. 7 is a flowchart showing a procedure executed by the control section 30 for the operation according to the second modification.

As shown in FIG. 7, after executing step S2, the control section 30 decides the value of the bias voltage V1 by use of a table shown in Table 3, based upon the toner density sensed by the sensor 34 (step S4). Table 3 shows the relation between the toner density and the bias voltage V1. Table 3 is stored in a storage section (not shown).

TABLE 3

| Toner Density | Small | Middle | Large |
|---|---|---|---|
| Bias Voltage V1 | −1.5 kV | −2 kV | −2.5 kV |

As shown in Table 3, the absolute value of the bias voltage V1 increases with increase in toner density. Accordingly, cleaning is performed with the bias voltage V1 having a larger absolute value when the amount of toner adhering to the secondary transfer roller 14 is larger. This prevents the use of the bias voltage V1 with an unnecessarily large absolute value when the amount of toner adhering to the secondary transfer roller 14 is small. Consequently, the power consumption of the image forming apparatus 1 can be reduced.

It is to be noted that in the image forming apparatus 1, the member to which the bias voltage is applied is not restricted to the secondary transfer roller 14. The bias voltage may be applied to a member that is opposed to (in contact with) the intermediate transfer belt 11 and to which toner adheres. Therefore, the bias voltage may be applied to the cleaning unit 18 of the intermediate transfer belt 11.

Further, the image carrier is not restricted to the intermediate transfer belt 11. When the image forming apparatus 1 is of a type that transfers a toner image from the photosensitive drum 4 directly to the paper P, the image carrier is the photosensitive drum 4. In this case, the bias voltage may be applied, for example, to the charger 5 that charges the photosensitive drum 4. Further, in this case, the charger 5 may apply the bias voltage to itself.

It should be noted that the control section 30 may make the voltage application section apply bias currents I1 and I2 in place of the bias voltages V1 and V2.

In the image forming apparatus according to the embodiment above, toner can be removed from an opposed member that is opposed to an image carrier.

Although the present invention has been described in connection with the preferred embodiments above, it is to be noted that various changes and modifications are possible to those who are skilled in the art. Such changes and modifications are to be understood as being within the scope of the present invention.

What is claimed is:

1. An image forming apparatus, comprising:

a charger;

an image carrier that carries a toner image;

a transfer member that is provided so as to be opposed to the image carrier and that transfers a toner image carried by the image carrier to a medium;

an application device that applies a bias to the transfer member; and a control device that controls the application device to apply a first bias and thereafter a second bias to the transfer member so as to remove toner from the transfer member;

wherein the first bias has an absolute value that is large enough to cause discharge from the transfer member into air;

the second bias has an absolute value that is too small to cause discharge from the transfer member into the air, and has a reverse polarity to the first bias;

the transfer member is shaped into a drum;

the control device controls the application device to apply each of the first bias and the second bias over a period when the transfer member makes one rotation; and the control device controls the application device to apply a bias having different polarity from the first bias before application of the first bias over a period when the transfer member makes one rotation.

2. The image forming apparatus according to claim 1, wherein the control device controls the application device to alternately apply to the transfer member a third bias and a fourth bias with different polarities from each other before applying the first bias.

3. The image forming apparatus according to claim 2, wherein the control device controls the application device to apply the third bias and the fourth bias over a period when the transfer member makes one rotation.

4. The image forming apparatus according to claim 1, further comprising:

a sensing device that senses an amount of toner adhering to the transfer member, wherein the control device controls the application device to apply the first bias and the second bias based upon a sensing result of the sensing device.

5. The image forming apparatus according to claim 1, wherein the absolute value of the first bias is in the range of 1.5 kV to 2.0 kV.

* * * * *